US011763733B2

(12) United States Patent
Yin et al.

(10) Patent No.: US 11,763,733 B2
(45) Date of Patent: Sep. 19, 2023

(54) DISPLAY DEVICE, SUB-PIXEL REPAIR CIRCUIT AND REPAIR METHOD THEREFOR

(71) Applicant: CHONGQING KONKA PHOTOELECTRIC TECHNOLOGY RESEARCH INSTITUTE CO., LTD., Chongqing (CN)

(72) Inventors: Chaowei Yin, Chongqing (CN); Zhongshan Feng, Chongqing (CN)

(73) Assignee: CHONGQING KONKA PHOTOELECTRIC TECHNOLOGY RESEARCH INSTITUTE CO., LTD., Chongqing (CN)

( * ) Notice: Subject to any disclaimer, the term of this patent is extended or adjusted under 35 U.S.C. 154(b) by 0 days.

(21) Appl. No.: 17/725,862

(22) Filed: Apr. 21, 2022

(65) Prior Publication Data

US 2022/0246091 A1 Aug. 4, 2022

Related U.S. Application Data

(63) Continuation of application No. PCT/CN2020/097702, filed on Jun. 23, 2020.

(51) Int. Cl.
*G09G 3/32* (2016.01)
*G09G 3/3233* (2016.01)

(52) U.S. Cl.
CPC ..... *G09G 3/32* (2013.01); *G09G 3/3233* (2013.01); *G09G 2330/08* (2013.01)

(58) Field of Classification Search
CPC .. G09G 3/32; G09G 2330/08; G09G 2330/10; G09G 2330/12; G09G 2300/0804; G09G 2300/0842; G09G 3/3233
See application file for complete search history.

(56) References Cited

U.S. PATENT DOCUMENTS 9,747,835 B2 * 8/2017 Lee ..... G09G 3/3233
10,461,123 B2 * 10/2019 Kim ..... H01L 27/1255
(Continued)

FOREIGN PATENT DOCUMENTS

CN 101833916 A 6/2013
CN 106251798 A 6/2018
(Continued)

OTHER PUBLICATIONS

Patent Cooperation Treaty: China International Property AdminisliaLion (ISA/CN): International Search Report and Written Opinion of PCT/CN2020/097702 (related application); dated Mar. 17, 2021; 12 pages (including translation).
(Continued)

*Primary Examiner* — Vijay Shankar

(57) ABSTRACT

A display device, a sub-pixel repair circuit and a repair method therefor. The sub-pixel repair circuit comprises a drive circuit module, a detection circuit module, a repair circuit module, a light-emitting device, and a standby light-emitting device; the drive circuit module is used for providing a drive current to the light-emitting device in response to a data signal of a data line and a scan signal of a scan line; the repair circuit module provides a drive current to the standby light-emitting device in response to a data signal provided by the drive circuit module and a short circuit signal or an open circuit signal provided by the detection circuit module. Thus, fault repair of the light-emitting device is implemented, and the display quality of a display device is improved.

14 Claims, 7 Drawing Sheets

(56) References Cited

U.S. PATENT DOCUMENTS

| | | | | |
|---|---|---|---|---|
| 10,510,277 | B2 * | 12/2019 | Wang | G09G 3/3233 |
| 2015/0123884 | A1 | 5/2015 | Kim | |
| 2016/0012773 | A1 * | 1/2016 | Lee | G09G 3/2007 345/78 |
| 2017/0032722 | A1 | 2/2017 | Wang | |
| 2022/0302354 | A1 * | 9/2022 | Kim | H01L 33/387 |
| 2022/0327996 | A1 * | 10/2022 | Yue | G09G 3/3233 |

FOREIGN PATENT DOCUMENTS

| | | | |
|---|---|---|---|
| CN | 109697956 | A | 4/2019 |
| CN | 110047425 | A | 7/2019 |
| CN | 110097842 | A | 8/2019 |
| CN | 110415643 | A | 11/2019 |
| CN | 111145684 | A | 5/2020 |
| CN | 111091780 | B | 4/2021 |
| CN | 108962106 | A | 2/2022 |

OTHER PUBLICATIONS

The State Intellectual Property Office of People's Republic of China: The First Office Action of Chinese Patent Application No. 202010578830.8, dated Dec. 28, 2021, Ying Feng; 16 pages (including translation).

The State Intellectual Property Office of People's Republic of China: The Second Office Action of Chinese Patent Application No. 202010578830.8, dated Feb. 21, 2022, Ying Feng; 9 pages (including translation).

* cited by examiner

DISPLAY DEVICE, SUB-PIXEL REPAIR CIRCUIT AND REPAIR METHOD THEREFOR

CROSS-REFERENCE TO RELATED APPLICATIONS

This application is a "bypass" Continuation application under 35 U.S.C. § 111(a), which claims priority to Patent Cooperation Treaty Application No. PCT/CN2020/097702, filed Jun. 23, 2020, entitled DISPLAY DEVICE, SUB-PIXEL REPAIR CIRCUIT AND REPAIR METHOD THEREFOR, the content of which is hereby incorporated by reference in its entirety.

TECHNICAL FIELD

The present disclosure relates to the field of display technology, and particularly to a display device, a sub-pixel repair circuit and a repair method thereof.

BACKGROUND

A micro light-emitting diode (Micro LED) is a light-emitting device using inorganic materials as light-emitting materials. Display devices using the Micro LEDs as the light-emitting devices have advantages of high brightness, a fast response speed, and a high stability.

In the related art, when a Micro LED display device is manufactured, thin film transistors arranged in an array are generally first formed on a circuit substrate, that is, a backplane is manufactured; and then a plurality of Micro LEDs arranged in an array are formed on another substrate; the material of the substrate can be an inorganic material such as monocrystalline silicon or gallium arsenide; finally, the plurality of Micro LEDs formed on the substrate are assembled in batches on the circuit substrate formed with the thin film transistors.

However, in the process of assembling the Micro LEDs in batches, due to the large number and small size of the Micro LEDs, some Micro LEDs may fail to be assembled. The Micro LEDs may fail for two reasons: one is short circuit, for example, when the Micro LED is assembled on the backplane, the two electrodes of the Micro LED are shorted, or the Micro LED is broken down and thus the Micro LED is shorted, etc.; the other is that the light-emitting diode is turned off, i.e., OFF, for example, the soldering causes disconnection of the electrodes during the assembly process, or both ends of the light-emitting diode are in the OFF state due to a overhigh voltage, etc. The short circuit and disconnection of the Micro LED both make the Micro LED fail to illuminate, which may affect the display effect of the display device.

Therefore, the conventional technology still needs to be improved.

SUMMARY

In view of the above-mentioned deficiencies of the prior art, the purpose of the present disclosure is to provide a display device, a sub-pixel repair circuit and a repair method thereof, which can effectively solve the problem of reduced display quality of the display device because the light-emitting device is not lit up when the fault occurs, thereby implementing the fault repair of the light-emitting device and improving the display quality of the display device.

In order to achieve the above purpose, the present disclosure provides the following technical solution.

A sub-pixel repair circuit is provided, which includes a circuit driver module, a circuit detection module, a circuit repair module, a light-emitting device and a backup light-emitting device; the circuit driver module being connected to a scan wire, a data wire, a first power supply terminal, the circuit detection module and the circuit repair module respectively; the circuit repair module being connected to the first power supply terminal, a positive electrode of the backup light-emitting device, and the circuit detection module; the circuit detection module being connected to a positive electrode of the light-emitting device; a negative electrode of the backup light-emitting device and a negative electrode of the light-emitting device being both connected to a second power supply terminal;

the circuit driver module is configured to provide a driving current to the light-emitting device in response to a data signal of the data wire and a scan signal of the scan wire;

the circuit repair module is configured to provide a driving current to the backup light-emitting device in response to a data signal provided by the circuit driver module and a short-circuit signal or a turn-off signal provided by the circuit detection module.

In the sub-pixel repair circuit, the circuit repair module includes a repair driver unit, a first repair unit and a second repair unit; the repair driver unit is connected to the first power supply terminal, the first repair unit, the second repair unit and the circuit driver module; the first repair unit is connected to the positive electrode of the backup light-emitting device and the circuit detection module; the second repair unit is connected to the positive electrode of the backup light-emitting device and the circuit detection module;

the repair driver unit is configured to output a driving current to the first repair unit or the second repair unit in response to the data signal;

the first repair unit is configured to output the driving current to the backup light-emitting device in response to the short-circuit signal;

the second repair unit is configured to output the driving current to the backup light-emitting device in response to the turn-off signal.

In the sub-pixel repair circuit, the circuit detection module includes a detection resistor; one end of the detection resistor is connected to the circuit driver module and the first repair unit, and the other end of the detection resistor is connected to the second repair unit and the positive electrode of the light-emitting device.

In the sub-pixel repair circuit, the first repair unit includes a first switch transistor; a short-circuit signal input terminal of the first switch transistor is connected to one end of the detection resistor, and a driving current input terminal of the first switch transistor is connected to the repair driver unit, and a driving current output terminal of the first switch transistor is connected to a positive electrode of a backup light-emitting device.

In the sub-pixel repair circuit, the second repair unit includes a second switch transistor; a driving current input terminal of the second switch transistor is connected to the repair driver unit, a turn-off signal input terminal of the second switch transistor is connected to the other end of the detection resistor, and a driving current output terminal of the second switch transistor is connected to the positive electrode of the backup light-emitting device.

In the sub-pixel repair circuit, the repair driver unit includes a first drive transistor; a data signal input terminal of the first drive transistor is connected to the circuit driver module, a driving current input terminal of the first drive transistor is connected to the first power supply terminal, and a driving current output terminal of the first drive transistor is connected to the first repair unit and the second repair unit.

In the sub-pixel repair circuit, the first switch transistor is a P-type transistor.

In the sub-pixel repair circuit, the second switch transistor is an N-type transistor.

In the sub-pixel repair circuit, the first drive transistor is an N-type transistor.

In the sub-pixel repair circuit, the circuit repair module includes a second drive transistor, a third switch transistor and an energy storage capacitor; a driving current input terminal of the second drive transistor is connected to the first power supply terminal, a data signal input terminal of the second driving transistor is connected to a data signal output terminal of the third switch transistor, a driving current output terminal of the second drive transistor is connected to the circuit detection module, a data signal input terminal of the third switch transistor is connected to the data wire, a scan signal input terminal of the third switch transistor is connected to the scan wire, a data signal output terminal of the third switch transistor is connected to the circuit repair module, one end of the energy storage capacitor is connected to the first power supply terminal, and the other end of the energy storage capacitor is connected to the data signal output terminal of the third switch transistor and the data signal input terminal of the second drive transistor.

In the sub-pixel repair circuit, the third switch transistor is an N-type transistor.

In the sub-pixel repair circuit, the second drive transistor is an N-type transistor.

A repair method for the above-mentioned sub-pixel repair circuit is provided, including:

- when the light-emitting device is turned on, driving, by the circuit driver module, the light-emitting device to illuminate;
- when the light-emitting device is shorted or turned off, driving, by the circuit repair module, the backup light-emitting device to illuminate.

In the repair method for the sub-pixel repair circuit, the driving, by the circuit repair module, the backup light-emitting device to illuminate includes:

- outputting, by a repair driver unit, a driving current to a first repair unit or a second repair unit in response to a data signal;
- outputting, by a first repair unit, a driving current to the backup light-emitting device in response to a short-circuit signal; or,
- outputting, by a second repair unit, the driving current to the backup light-emitting device in response to a turn-off signal.

A display device is provided, including a pixel array, the pixel array includes at least one pixel circuit, and the pixel circuit comprises three the above-mentioned sub-pixel repair circuits.

Compared to the conventional technology, the present disclosure provides that the sub-pixel repair circuit includes a circuit driver module, a circuit detection module, a circuit repair module, a light-emitting device and a backup light-emitting device; the circuit driver module is connected to a scan wire, a data wire, a first power supply terminal, the circuit detection module and the circuit repair module respectively; the circuit repair module is connected to the first power supply terminal, a positive electrode of the backup light-emitting device, and the circuit detection module; the circuit detection module is connected to a positive electrode of the light-emitting device; a negative electrode of the backup light-emitting device and a negative electrode of the light-emitting device are both connected to a second power supply terminal; the circuit driver module is configured to provide a driving current to the light-emitting device in response to a data signal of the data wire and a scan signal of the scan wire; the circuit repair module is configured to provide a driving current to the backup light-emitting device in response to a data signal provided by the circuit driver module and a short-circuit signal or a turn-off signal provided by the circuit detection module. Accordingly, the fault repair of the light-emitting device is implemented, and the display quality of the display device is improved.

DETAILED DESCRIPTION

The present disclosure provides a display device, a sub-pixel repair circuit and a repair method thereof, which can effectively solve the problem that the display quality of the display device is reduced because the light-emitting device does not illuminate when failing, thereby implementing the failure report of the light-emitting device and improving the display quality of the display device.

In order to make the purpose, technical solution and the effects of the present disclosure clearer and more specific, the present disclosure will be further described in detail below with reference to accompanying drawings and embodiments. It should be understood that the specific embodiments described herein are merely used for explaining the present disclosure, rather than limiting the present disclosure.

Figure 1:
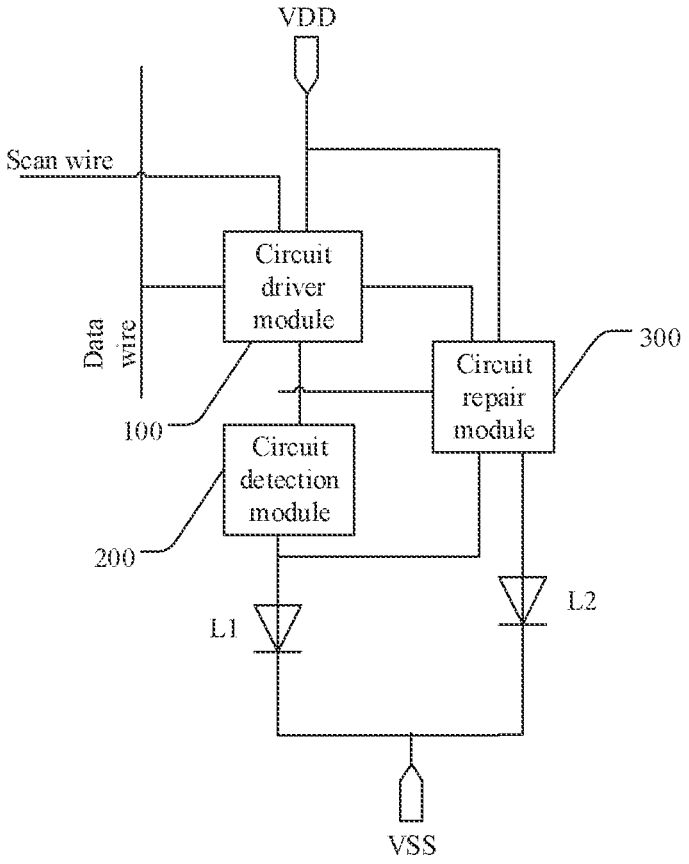
FIG. 1 is a structure block diagram of a sub-pixel repair circuit according to the present disclosure.

Referring to FIG. 1, the sub-pixel repair circuit provided by the present disclosure includes a circuit driver module 100, a circuit detection module 200, a circuit repair module 300, a light-emitting device and a backup light-emitting device L2. The circuit driver module 100 is connected to a scan wire, a data wire, a first power supply terminal VDD, the circuit detection module 200 and the circuit repair module 300 respectively. The circuit repair module 300 is connected to the first power supply terminal VDD, a positive electrode of the backup light-emitting device L2, and the circuit detection module 300. The circuit detection module 200 is connected to a positive electrode of the light-emitting device L1. A negative electrode of the backup light-emitting device L2 and a negative electrode of the light-emitting device L1 are both connected to a second power supply terminal VSS.

The circuit driver module 100 is configured to provide a driving current to the light-emitting device L1 in response to a data signal of the data wire and a scan signal of the scan wire. The circuit repair module 300 is configured to provide a driving current to the backup light-emitting device L2 in response to a data signal provided by the circuit driver module 100 and a short-circuit signal or a turn-off signal provided by the circuit detection module 200.

Specifically, in a data writing stage, in response to the scan signal of the scan wire, the data signal on the data wire is written into the circuit driver module 100 is stored in the circuit driver module 100.

In a light-emitting stage, when the light-emitting device L1 does not fail, the circuit driver module 100 responds to the data signal, and the current inputted from the first power supply terminal VDD passes through the circuit driver module 100 to the circuit detection module 200, and passes through the light-emitting device L1 to the second power supply terminal VSS, accordingly a path is formed, and the light-emitting device L1 is normally lit. When the light-emitting device L1 fails, the light-emitting device does not emit light; and after detecting a corresponding fault signal, that is, the short-circuit signal or the turn-off signal, the circuit detection module 200 outputs the fault signal to the circuit repair module 300, so that the circuit repair module 300 responds to the fault signal and the data signal provided by the circuit driver module 100, such that the current inputted from the first power supply terminal VDD passes through the circuit repair module 300, and passes through the backup light-emitting device L2 to the second power supply terminal VSS, and accordingly a path is formed, and the backup light-emitting device L2 is lit. Accordingly, the fault repairing of the light-emitting device is implemented and the display quality of the display device is improved.

Figure 2:
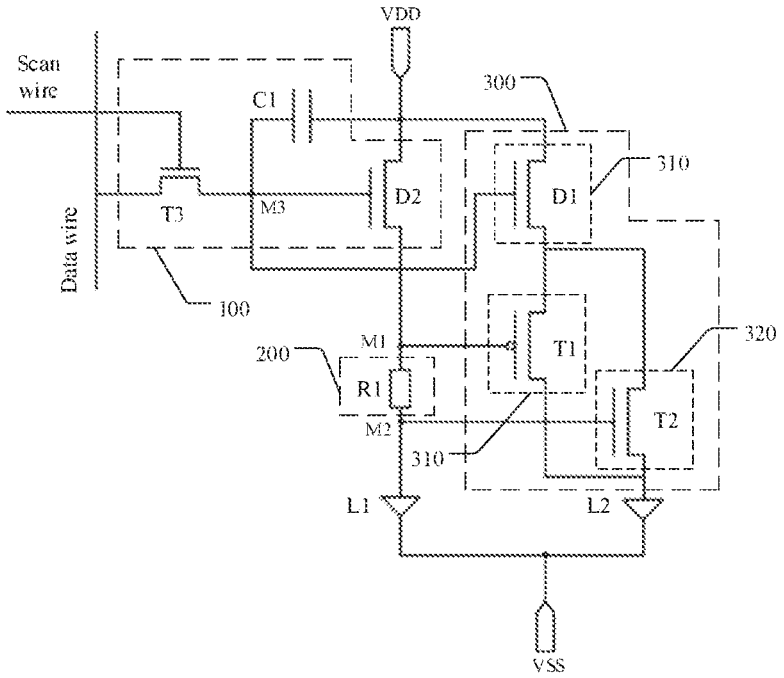
FIG. 2 is a schematic diagram of a circuit principle of a sub-pixel repair circuit according to the present disclosure.

Further, referring to FIG. 2, the circuit repair module 300 includes a repair driver unit 310, a first repair unit 320 and a second repair unit 330. A driving current input terminal of the repair driver unit 310 is connected to the first power supply terminal VDD. The data signal input terminal of the repair driver unit 310 is connected to the circuit driver module 100; the driving current output terminal of the repair driver unit 310 is connected to the driving current input terminal of the first repair unit 320 and the driving current input terminal of the second repair unit 330. The short-circuit signal input terminal of the first repair unit 320 is connected to an input terminal of the circuit detection module 200; the driving current output terminal of the first repair unit 320 is connected to the positive electrode of the backup light-emitting device L2; the turn-off signal input terminal of the second repair unit 330 is connected to an output terminal of the circuit detection module 200; and the driving current output terminal of the second repair unit 330 is connected to the positive electrode of the backup light-emitting device L2.

Specifically, the repair driver unit 310 outputs the driving current to the first repair unit 320 or the second repair unit 330 in response to the data signal. The first repair unit 320 outputs the driving current to the backup light-emitting device L2 in response to the short-circuit signal. The second repair unit 330 outputs the driving current to the backup light-emitting device L2 in response to the turn-off signal. When the light-emitting device L1 is shorted, the repair driver unit 310 is still turned on according to the data signal outputted by the circuit driver module 100. The first repair unit 320 is turned on after receiving the short-circuit signal from the circuit detection module 200; at this moment, the current of the first power supply terminal VDD passes through the repair driver unit 310 to the first repair unit 320, and passes through the backup light-emitting device L2 to the second power supply terminal VSS, accordingly a pat is formed and the backup light-emitting device L2 is lit and emits light, thereby implementing the repair of the short circuit fault of the light-emitting device L1.

When the light-emitting device L1 is turned off, the repair driver unit 310 is still turned on according to the data signal outputted by the circuit driver module 100, and the second repair unit 330 is turned on after receiving a turn-off signal of the circuit detection module 200 at this moment; this time, the current of the first power supply terminal VDD passes through the repair driver unit 310 to the second repair unit 330, and then passes through the backup light-emitting device L2 to the second power supply terminal VSS to form a path, then the backup light-emitting device L2 is lit and emits light, thereby implementing the repair of the turn off fault of the light-emitting device.

It should be noted that the backup light-emitting device L2 in the present disclosure may be a newly added light-emitting device, or a light-emitting device connected in parallel with and adjacent to the light-emitting device L1. In the embodiment I of the present disclosure, the backup light-emitting device L2 is taken as a newly added light-emitting device as an example to illustrate.

Specifically, the circuit detection module 200 includes a detection resistor R1. One end of the detection resistor R1 is connected to the driving current output terminal of the circuit driver module 100 and the short-circuit signal input terminal of the first repair unit 320. The other end of the circuit detection module 200 is connected to the positive electrode of the light-emitting device L1 and the turn-off signal input terminal of the second repair unit 330. One end of the detection resistor R1, the driving current output terminal of the circuit driver module 100 and the short-circuit signal input terminal of the first repair unit 320 intersect at a point M1; the other end of the detection resistor R1, the turn-off signal input terminal of the second repair module and the positive electrode of the light-emitting device L1 intersect at a point M2.

Figure 3:
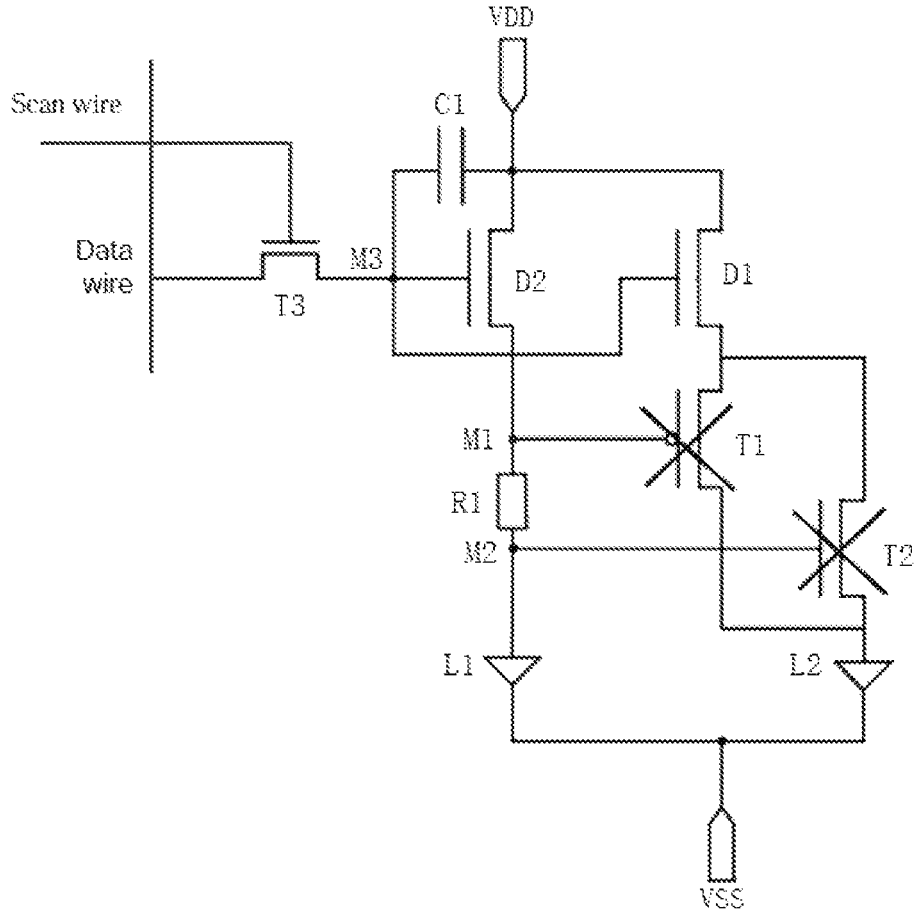
FIG. 3 is a schematic diagram of a circuit principle of an equivalent circuit of a sub-pixel repair circuit when a light-emitting device operate normally according to an embodiment I of the present disclosure.

When the light-emitting device L1 does not fail, as shown in FIG. 3, the current of the first power supply terminal VDD passes through the circuit driver module 100 to the detection resistor R1, and passes through the light-emitting device L1 to the second power supply terminal VSS to form a path. At this time, a voltage at the node M1 is equal to $V1+V_{L1}+V_{R1}$; $V_{L1}$ is a voltage difference between both ends of the light-emitting device L1; $V_{R1}$ is a voltage across the detection resistor R1; and V1 is a voltage at the second power supply terminal VSS. A voltage corresponding to the short-circuit signal input terminal of the first repair unit 320 is equal to $V1+V_{L1}+V_{R1}$; and the first repair unit 320 is turned off; a voltage at the node M3 is equal to $V1+V_{L1}$, that is, a voltage at the turn-off signal input terminal of the second repair unit 330 is equal to $V1+V_{L1}$, and the second repair unit 330 is turned off.

Figure 4:
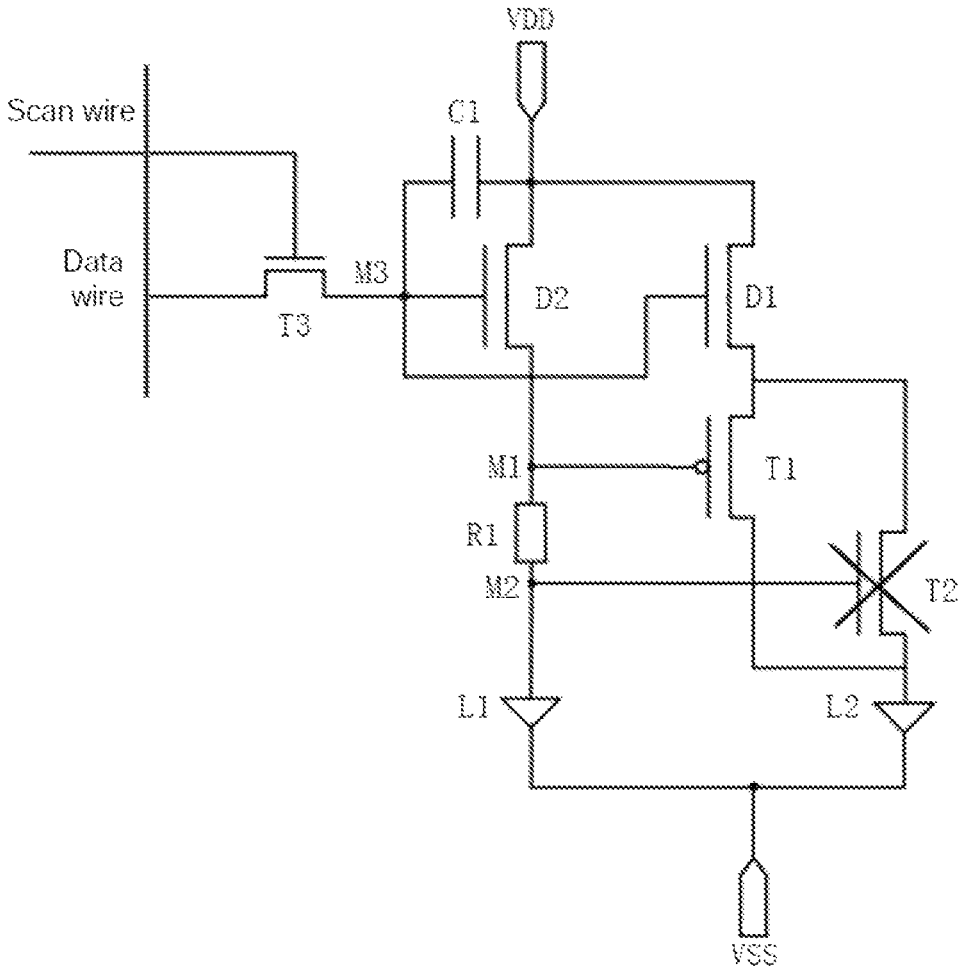
FIG. 4 is a schematic diagram of a circuit principle of an equivalent circuit of the sub-pixel repair circuit when the light-emitting device is shorted according to the embodiment I of the present disclosure.
Figure 5:
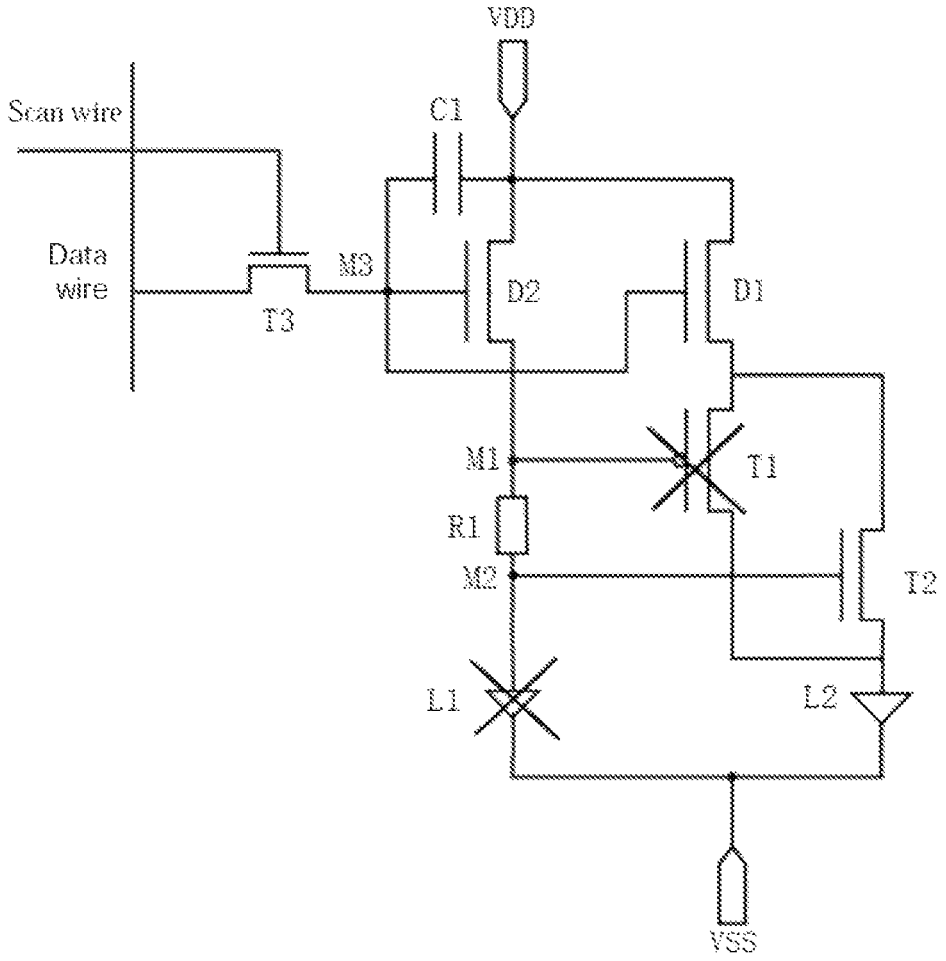
FIG. 5 is a schematic diagram of a circuit principle of an equivalent circuit of the sub-pixel repair circuit when the light-emitting device is turned off according to the embodiment I of the present disclosure.

When the light-emitting device L1 is shorted, as shown in FIG. 4, the current of the first power supply terminal VDD passes through the circuit driver module 100 to the detection resistor R1, and then passes through the detection resistor R1 to the second power supply terminals VSS to form a path; the voltage at the node M1 changes to $V1+V_{R1}$; the short-circuit signal input terminal of the first repair unit 320 is turned on after receiving the corresponding short-circuit signal; and the voltage at the node M2 is equal to V1, so that the second repair unit 330 is turned off. As shown in FIG. 5, when the light-emitting device L1 is turned off, the path of the detection resistor R1 is disconnected, and the voltages at the node M1 and the node M2 are both equal to V2, in which V2 is equal to the voltage at the first power supply terminal VDD. The voltages at the short-circuit signal input terminal of the first repair unit 320 and the turn-off signal input terminal of the second repair unit 330 are both equal to V2, and the corresponding first repair unit 320 is turned off, the second repair unit 330 is turned on. Thus, by providing the detection resistor R1, when the light-emitting device L1 is shorted or turned off, a short-circuit signal can be effectively provided for the first repair unit 320, or a turn-off signal can be effectively provided for the second repair unit 330 to facilitate the subsequent fault repairing.

Further, please continue to refer to FIG. 2, the first repair unit 320 includes a first switch transistor T1. A short-circuit signal input terminal of the first switch transistor T1 is connected to one end of the detection resistor R1 and the driving circuit output terminal of the circuit driver module 100. A driving current input terminal of the first switch transistor T1 is connected to the driving current output terminal of the repair driver unit 310; and a driving current output terminal of the first switch transistor T1 is connected to the negative electrode of the backup light-emitting device L2. In this embodiment, the first switch transistor T1 is a P-type transistor; and the P-type transistor is triggered and turned on by a low-level signal; a short-circuit signal input terminal of the first switch transistor T1 is a gate terminal; the driving current input terminal of the first switch transistor T1 is a source terminal; and the driving current output terminal of the first switch transistor T1 is a drain terminal. In the following embodiments, $V_{gs}$ represents a voltage difference between a base and a source of a transistor; $V_{th}$ represents a threshold voltage of the transistor, and $|V_{L1}|>|V_{th}|$. Specifically, when the light-emitting device L1 operates normally, as shown in FIG. 3, the voltage at the node M1 is equal to $V1+V_{L1}+V_{R1}$, and the first switch transistor T1 satisfies $|V_{gs}|>|V_{th}|$, and the first switch transistor T1 is turned off. When the light-emitting device L1 is shorted, as shown in FIG. 4, the voltage at the node M1 changes to $V1+V_{R1}$, and the first switch transistor satisfies $V_{gs}$ and the first switch transistor T1 is turned on. When the light-emitting device L1 is turned off, as shown in FIG. 5, the voltage at the node M1 changes to V2, the first switch transistor T1 satisfies $|V_{gs}|>|V_{th}|$, and the first switch transistor T1 is turned off. Thus, the first switch transistor T1 is arranged to turn on or off according to different connection states of the light-emitting device L1, to implement the subsequent fault repairing.

Further, please continue by referring to FIG. 2, the second repair unit 330 includes a second switch transistor T. A driving current input terminal of the second switch transistor T2 is connected to the driving current output terminal of the repair driver unit 310; a turn-off signal input terminal of the second switch transistor T2 is connected to the other end of the detection resistor R1; and a driving current output terminal of the second switch transistor T2 is connected to the positive electrode of the backup light-emitting device L2. In this embodiment, the second switch transistor T2 is an N-type transistor which is triggered and turned on by a high-level signal; the driving current input terminal of the second switch transistor T2 is a drain terminal; the turn-off signal input terminal of the second switch transistor T2 is a gate terminal; the driving current output terminal of the second switch transistor T2 is a source terminal. Specifically, when the light-emitting device L1 operates normally, as shown in FIG. 3, the voltage at the node M2 is equal to $V1+V_{L1}$, and the second switch transistor T2 satisfies $|V_{gs}|<|V_{th}|$, and the second switch transistor T2 is turned off. When the light-emitting device L1 is shorted, as shown in FIG. 4, the voltage at the node M2 is VSS, and this moment the second switch transistor T2 satisfies $|V_{gs}|<|V_{th}|$, and the second switch transistor T2 is turned off. When the light-emitting device L1 is turned off, as shown in FIG. 5, the voltage at the node M2 changes to V2, and this moment the second switch transistor T2 satisfies $|V_{gs}|>|V_{th}|$, and the second switch transistor T2 is turned on. Thus, the second switch transistor T2 is arranged to turn on or off according to different connection states of the light-emitting device L1, to implement the subsequent fault repairing.

Further, please continue by referring to FIG. 2, the repair driver unit 310 includes a first drive transistor D1. The repair driver unit 310 includes a first drive transistor D1; a data signal input terminal of the first drive transistor D1 is connected to the circuit driver module 100; a driving current input terminal of the first drive transistor D1 is connected to the first power supply terminal VDD; a driving current output terminal of the first drive transistor D1 is connected to the driving current input terminal of the first switch transistor T1 and the driving current input terminal of the second switch transistor T2. The first drive transistor D1 is turned on when receiving the data signal outputted from the circuit driver module 100; accordingly, the current inputted by the first power supply terminal VDD passes through the first switch transistor T1 or the second switch transistor T2 to provide the driving current to the standby light-emitting deice L2, in order to implement the fault repairing.

Further, the circuit driver module 100 includes a second drive transistor D2, a third switch transistor T3 and an energy storage capacitor C1. A driving current input terminal of the second drive transistor D2 is connected to the first power supply terminal VDD; a data signal input terminal of the second drive transistor D2 is connected to the data signal output terminal of the third switch transistor T3; a driving current output terminal of the second drive transistor D2 is connected to one end of the detection resistor R1; the data signal input terminal of the third switch transistor T3 is connected to the data wire; the scan signal input terminal of the third switch transistor T3 is connected to the scan wire; and the data signal output terminal of the third switch transistor T3 is also connected to the data signal input terminal of the first drive transistor D1. One end of the energy storage capacitor C1 is connected to the first power supply terminal VDD; and the other end of the energy storage capacitor C1 is connected to the data signal output terminal of the third switch transistor T3 and the data signal input terminal of the second drive transistor D2. The other end of the energy storage capacitor C1, the data signal output terminal of the third switch transistor T3 and the data signal input terminal of the second drive transistor D2 intersect at a point M3.

In this embodiment, the second drive transistor D2 is an N-type transistor. When the scan wire inputs a high-level signal, i.e., a scan signal, the third switch transistor T3 is turned on; and this moment the data wire writes the data signal through the third switch transistor T3, i.e., a data voltage, so that the first drive transistor D1 and the second drive transistor D2 are turned on, in order to provide driving current for the light-emitting device L1 and the backup light-emitting device L2. Meanwhile, the energy storage capacitor C1 stores the data voltage to maintain a potential difference between the first power supply terminal VDD and the node M3 and ensure the normal drive operation of the first drive transistor D1 and the second drive transistor D2.

Figure 6:
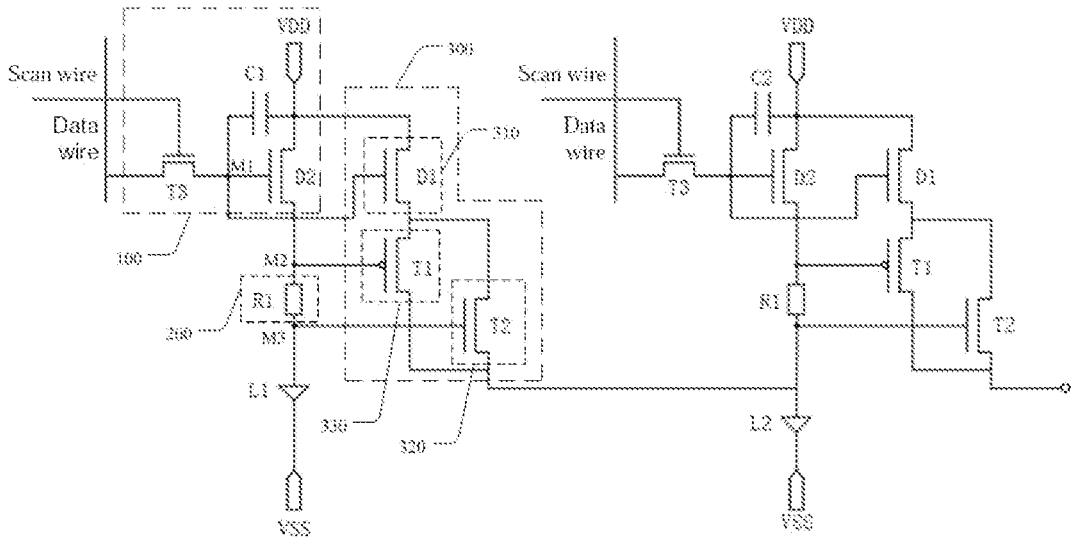
FIG. 6 is a schematic diagram of a circuit principle of a sub-pixel repair circuit according to an embodiment II of the present disclosure.

Further, referring to FIG. 6, in the second embodiment of the present disclosure, the backup light-emitting device L2 can be a light-emitting device connected in parallel with and adjacent to the light-emitting device L1. When the light-emitting device L1 is shorted, the first switch transistor T1 is turned on, the second switch transistor T2 is turned off, and the current of the first power supply terminal VDD passes through the first drive transistor D1 to the first switch transistor T1, and then passes through the first switch transistor T1 to the adjacent light-emitting device, in order to provide the driving current to the adjacent light-emitting device, so that the adjacent light-emitting device is lit with the driving current in the sub-pixel repair circuit on the basis of the original driving current, accordingly the adjacent light-emitting device can emit stronger light, the brightness value is improved, to replace the original light of the light-emitting device L1, thereby implementing the short circuit repair. When the light-emitting device L1 is turned off, the first switch transistor T1 is turned off, the second switch transistor T2 is turned on; and the current of the first power supply terminal VDD passes through the first drive transistor D1 to the second switch transistor T2, and then passes through the second switch transistor T2 to the adjacent light-emitting device, to provide the driving current to the adjacent light-emitting device, so that the adjacent light-emitting device is lit with the driving current in the sub-pixel repair circuit on the basis of the original driving current, accordingly the adjacent light-emitting device can emit stronger light, the brightness value is improved, to replace the original light of the light-emitting device L1, thereby implementing the repair of the disconnection and improving the display quality of the display device.

Figure 7:
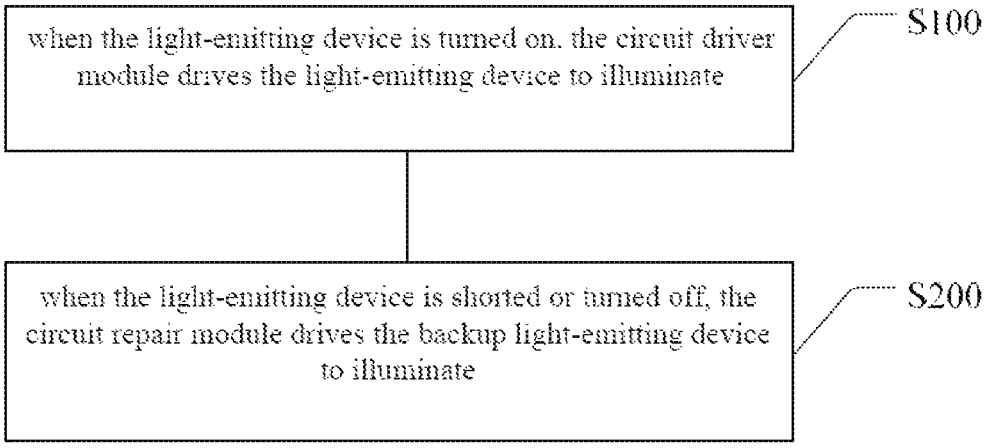
FIG. 7 is a flow chart showing a repair method for a sub-pixel repair circuit according to the present disclosure.

The present disclosure further provides a repair method based on the sub-pixel repair circuit. Referring to FIG. 7, the repair method based on the sub-pixel repair circuit includes the following steps:

S100: when the light-emitting device is turned on, the circuit driver module drives the light-emitting device to illuminate;

S200: when the light-emitting device is shorted or turned off, the circuit repair module drives the backup light-emitting device to illuminate.

Figure 8:
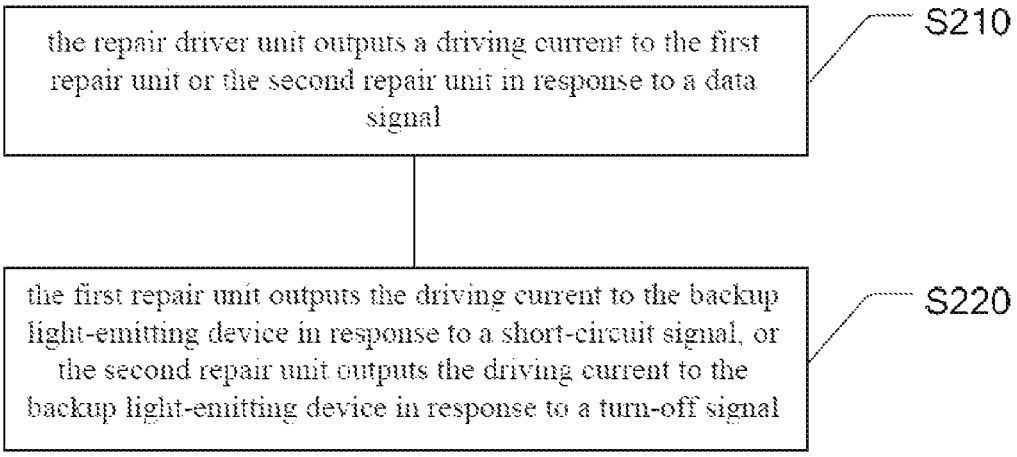
FIG. 8 is a flow chart of a step S200 in a repair method for a sub-pixel repair circuit according to the present disclosure.

Further, referring to FIG. 8, the step S200 specifically includes:

S210: the repair driver unit outputs a driving current to the first repair unit or the second repair unit in response to a data signal;

S220: the first repair unit outputs the driving current to the backup light-emitting device in response to a short-circuit signal, or the second repair unit outputs the driving current to the backup light-emitting device in response to a turn-off signal.

Further, the present disclosure further provides a display device, the display device includes a pixel array, and the pixel array includes at least one pixel circuit, in which the pixel circuit includes three sub-pixel repair circuits as described above. The sub-pixel repair circuit is described in detail in the text, and will not be repeated here. By providing the sub-pixel repair circuit in the display device, when the light-emitting device fails, the sub-pixel repair circuit can be utilized to repair the fault effectively, thereby improving the display quality of the display device.

In conclusion, the present disclosure provides a display device, a sub-pixel repair circuit and a repair method thereof. The sub-pixel repair circuit includes a circuit driver module, a circuit detection module, a circuit repair module, a light-emitting device and a backup light-emitting device. The circuit driver module is connected to the scan wire, the data wire, the first power supply terminal, the circuit detection module and the circuit repair module respectively; and the circuit repair module is connected to the first power supply terminal, the positive electrode of the backup light-emitting device, and the circuit detection module; the circuit detection module is connected to the positive electrode of the light-emitting device; the negative electrode of the backup light-emitting device and the negative electrode of the light-emitting device are both connected to the second power supply terminal. The circuit driver module is configured to provide the driving current to the light-emitting device in response to the data signal of the data wire and the scan signal of the scan wire; the circuit repair module is configured to provide the driving current to the backup light-emitting device in response to the data signal provided by the circuit driver module and the short-circuit signal or the turn-off signal provided by the circuit detection module, thereby implementing the fault repairing of the light-emitting device and improving the display quality of the display device.

It can be appreciated that those of ordinary skill in the art can make equivalent replacements or variations according to the technical solution of the present disclosure and the inventive concept thereof, and all these variations or replacements should fall within the protection scope of the appended claims of the present disclosure.

What is claimed is:

1. A sub-pixel repair circuit, comprising a circuit driver module, a circuit detection module, a circuit repair module, a light-emitting device and a backup light-emitting device; the circuit driver module being connected to a scan wire, a data wire, a first power supply terminal, the circuit detection module and the circuit repair module respectively; the circuit repair module being connected to the first power supply terminal, a positive electrode of the backup light-emitting device, and the circuit detection module; the circuit detection module being connected to a positive electrode of the light-emitting device; a negative electrode of the backup light-emitting device and a negative electrode of the light-emitting device being both connected to a second power supply terminal;

wherein the circuit driver module is configured to provide a driving current to the light-emitting device in response to a data signal of the data wire and a scan signal of the scan wire;

wherein the circuit repair module is configured to provide a driving current to the backup light-emitting device in response to a data signal provided by the circuit driver module and a short-circuit signal or a turn-off signal provided by the circuit detection module;

wherein the circuit repair module comprises a repair driver unit, a first repair unit and a second repair unit the repair driver unit is connected to the first power supply terminal, the first repair unit, the second repair unit and the circuit driver module; the first repair unit is connected to the positive electrode of the backup light-emitting device and the circuit detection module; the second repair unit is connected to the positive electrode of the backup light-emitting device and the circuit detection module;

the repair driver unit is configured to output a driving current to the first repair unit or the second repair unit in response to the data signal;

the first repair unit is configured to output the driving current to the backup light-emitting device in response to the short-circuit signal;

the second repair unit is configured to output the driving current to the backup light-emitting device in response to the turn-off signal.

2. The sub-pixel repair circuit according to claim 1, wherein the circuit detection module comprises a detection resistor; one end of the detection resistor is connected to the circuit driver module and the first repair unit, and the other end of the detection resistor is connected to the second repair unit and the positive electrode of the light-emitting device.

3. The sub-pixel repair circuit according to claim 2, wherein the first repair unit comprises a first switch transistor; a short-circuit signal input terminal of the first switch transistor is connected to one end of the detection resistor, and a driving current input terminal of the first switch transistor is connected to the repair driver unit, and a driving current output terminal of the first switch transistor is connected to a positive electrode of a backup light-emitting device.

4. The sub-pixel repair circuit according to claim 3, wherein the first switch transistor is a P-type transistor.

5. The sub-pixel repair circuit according to claim 2, wherein the second repair unit comprises a second switch transistor; a driving current input terminal of the second switch transistor is connected to the repair driver unit, a turn-off signal input terminal of the second switch transistor is connected to the other end of the detection resistor, and a driving current output terminal of the second switch transistor is connected to the positive electrode of the backup light-emitting device.

6. The sub-pixel repair circuit according to claim 5, wherein the second switch transistor is an N-type transistor.

7. The sub-pixel repair circuit according to claim 2, wherein the repair driver unit comprises a first drive transistor; a data signal input terminal of the first drive transistor is connected to the circuit driver module, a driving current input terminal of the first drive transistor is connected to the first power supply terminal, and a driving current output terminal of the first drive transistor is connected to the first repair unit and the second repair unit.

8. The sub-pixel repair circuit according to claim 7, wherein the first drive transistor is an N-type transistor.

9. The sub-pixel repair circuit according to claim 1, wherein the circuit repair module comprises a second drive transistor, a third switch transistor and an energy storage capacitor; a driving current input terminal of the second drive transistor is connected to the first power supply terminal, a data signal input terminal of the second driving transistor is connected to a data signal output terminal of the third switch transistor, a driving current output terminal of the second drive transistor is connected to the circuit detection module, a data signal input terminal of the third switch transistor is connected to the data wire, a scan signal input terminal of the third switch transistor is connected to the scan wire, a data signal output terminal of the third switch transistor is connected to the circuit repair module, one end of the energy storage capacitor is connected to the first power supply terminal, and the other end of the energy storage capacitor is connected to the data signal output terminal of the third switch transistor and the data signal input terminal of the second drive transistor.

10. The sub-pixel repair circuit according to claim 9, wherein the third switch transistor is an N-type transistor.

11. The sub-pixel repair circuit according to claim 9, wherein the second drive transistor is an N-type transistor.

12. A repair method based on the sub-pixel repair circuit of claim 1, comprising:

when the light-emitting device is turned on, driving, by the circuit driver module, the light-emitting device to illuminate;

when the light-emitting device is shorted or turned off, driving, by the circuit repair module, the backup light-emitting device to illuminate.

13. The repair method for the sub-pixel repair circuit according to claim 12, wherein the driving, by the circuit repair module, the backup light-emitting device to illuminate comprises:

outputting, by a repair driver unit, a driving current to a first repair unit or a second repair unit in response to a data signal;

outputting, by a first repair unit, a driving current to the backup light-emitting device in response to a short-circuit signal; or, outputting, by a second repair unit, the driving current to the backup light-emitting device in response to a turn-off signal.

14. A display device, comprising a pixel array, wherein the pixel array comprises at least one pixel circuit, and the pixel circuit comprises three sub-pixel repair circuits of claim 1.

* * * * *